US005798004A

United States Patent [19]

Tamehiro et al.

[11] Patent Number: 5,798,004

[45] Date of Patent: Aug. 25, 1998

[54] WELDABLE HIGH STRENGTH STEEL HAVING EXCELLENT LOW TEMPERATURE TOUGHNESS

[75] Inventors: Hiroshi Tamehiro; Hitoshi Asahi; Takuya Hara, all of Futtsu; Yoshio Terada, Kimitsu, all of Japan

[73] Assignee: Nippon Steel Corporation, Tokyo, Japan

[21] Appl. No.: 714,098

[22] PCT Filed: Jan. 26, 1996

[86] PCT No.: PCT/JP96/00155

§ 371 Date: Jan. 14, 1997

§ 102(e) Date: Jan. 14, 1997

[87] PCT Pub. No.: WO96/23083

PCT Pub. Date: Aug. 1, 1996

[30] Foreign Application Priority Data

| | | | |
|---|---|---|---|
| Jan. 26, 1995 | [JP] | Japan | 7-011081 |
| Feb. 3, 1995 | [JP] | Japan | 7-017303 |
| Feb. 6, 1995 | [JP] | Japan | 7-018307 |

[51] Int. Cl.[6] ..... C22C 38/08; C22C 38/48

[52] U.S. Cl. ..... 148/336; 148/330; 148/335; 420/119

[58] Field of Search ..... 148/336, 335, 148/330; 420/119, 120

[56] References Cited

U.S. PATENT DOCUMENTS

| | | | |
|---|---|---|---|
| 5,213,634 | 5/1993 | Deardo et al. | 148/334 |
| 5,454,883 | 10/1995 | Yoshie et al. | 148/336 |

FOREIGN PATENT DOCUMENTS

| | | |
|---|---|---|
| 54-68719 | 6/1979 | Japan . |
| 63-7328 | 1/1988 | Japan . |
| 2-250941 | 10/1990 | Japan . |
| 4-279247 | 10/1992 | Japan . |
| 5-148582 | 6/1993 | Japan . |

OTHER PUBLICATIONS

NKK Engineering Report No. 138 (1992), M. Nagae et al., "Development of X100 UOE Line Pipe", pp. 24–31.

Proceedings Of The Seventh International Conference On Offshore Mechanics And Arctic Engineering, OMAE 1988, Houston, T. Hashimoto et al., "Recent Developments Of Large Diameter Line Pipe Of Grade X–80 and X–100", pp. 179–185.

*Primary Examiner*—Deborah Yee
*Attorney, Agent, or Firm*—Kenyon & Kenyon

[57] ABSTRACT

This invention adds elements such as Cu, B, Cr, Ca, V, etc., to a low carbon-high Mn—Ni—Mo-trace Ti type steel, and allows the steel to have a tempered martensite/bainite mixed structure containing at least 60% of tempered martensite transformed from un-recrystallized austenite having a mean austenite grain size (dγ) of not greater than 10 μm as a micro-structure, or a tempered martensite structure containing at least 90% of martensite transformed from un-recrystallized austenite. The present invention further stipulates a P value to the range of 1.9 to 4.0 and thus provides a ultra-high strength steel having a tensile strength of at least 950 MPa (not lower than 100 of the API standard) and excellent in low temperature toughness, HAZ toughness and field weldability in cold districts.

9 Claims, 1 Drawing Sheet

WELDABLE HIGH STRENGTH STEEL HAVING EXCELLENT LOW TEMPERATURE TOUGHNESS

TECHNICAL FIELD

This invention relates to an ultra-high strength steel having a tensile strength (TS) of at least 950 MPa and excellent in low temperature toughness and weldability, and this steel can widely be used for line pipes for transporting natural gases and crude oils and as a weldable steel material for various pressure containers and industrial machinery.

BACKGROUND ART

Recently, the required strength of line pipes used for the long distance transportation of crude oils and natural gases has become higher and higher due to (1) an improvement in transportation efficiency by higher pressure, and (2) an improvement in laying efficiency due to the reduction of outer diameters and weights of line pipes. Line pipes having a strength of up to X80 according to the American Petroleum Institute (API) (at least 620 MPa in terms of tensile strength) have been put into practical application in the past, but the need for line pipes having a higher strength has increased.

Conventionally, an ultra-low carbon-high Mn—Nb—(Mo)—(Ni)-trace B-trace Ti steel has been known as a line pipe steel having a structure comprising mainly fine bainite, but the upper limit of its tensile strength is at most 750 MPa. In this basic chemical composition system, an ultra-high strength steel having a structure mainly comprising fine martensite does not exist. It had been believed that a tensile strength exceeding 950 MPa can never be attained by the structure mainly comprising bainite and furthermore, the low temperature toughness is deteriorated if the martensite structure increases.

Studies on the production method of ultra-high strength line pipes have been made at present on the basis of the conventional X80 line pipe production technologies (for example, "NKK Engineering Report", No. 138 (1992), pp. 24–31, and "The 7th Offshore Mechanics and Arctic Engineering" (1998), Volume V, pp. 179–185), but the production of line pipes of X100 (tensile strength of at least 760 MPa) is believed to be the limit according to these technologies.

To achieve an ultra-high strength in pipe lines, there are a large number of problems yet to be solved such as the balance of strength and low temperature toughness, toughness of a welding heat affected zone (HAZ), field weldability, softening of a joint, and so forth, and an rapid development of a revolutionary ultra-high strength line pipe (exceeding X100) has been sought.

To satisfy the requirements described above, the present invention aims at providing an ultra-high strength weldable steel having an excellent balance between the strength and the low temperature toughness, being easily weldable on field and having a tensile strength of at least 950 MPa (exceeding X100 of the API standard).

DISCLOSURE OF THE INVENTION

The inventors of the present invention have conducted intensive studies on the chemical components (compositions) of steel materials and their micro-structures in order to obtain an ultra-high strength steel having a tensile strength of at least 950 MPa and excellent in low temperature toughness and field weldability, and have invented a new ultra-high strength weldable steel.

It is the first object of the present invention to provide a new ultra-high strength weldable steel, which is a low carbon-high Mn type steel containing Ni—Mo—Nb-trace Ti compositely added thereto, and having a tensile strength of at least 950 MPa and excellent in low temperature toughness and site weldability in cold districts.

It is the second object of the present invention to provide a steel which has a P value, defined by the following chemical formula, within the range of 1.9 to 4.0 in the chemical compositions constituting the ultra-high strength weldable steel described above. Needless to say, this P value changes somewhat depending on various ultra-high strength weldable steels provided by the present invention.

The term "P value" (hardenability index) defined in the present invention represents a hardenability index. When this P value takes a high value, it indicates that the structure is likely to transform to a martensite or bainite structure. It is an index that can be used as a strength estimation formula of steels, and can be expressed by the following general formula:

$$P=2.7C+0.4Si+Mn+0.8Cr+0.45(Ni+Cu)+(1+\beta)MO+V-1+\beta$$

where β is 0 when B is less than 3 ppm and β is when B is greater than or equal to 3 ppm.

It is the third object of the present invention to provide a weldable high strength steel excellent in low temperature toughness, wherein the chemical compositions constituting the ultra-high strength weldable steel and the micro-structure of the steel have a specific structure, the micro-structure contains at least 60%, in terms of volume fraction, of martensite transformed from un-recrystallized austenite having an apparent mean austenite grain size (dγ) of not greater than 10 μm in a suitable combination with the chemical compositions constituting the steel, and the sum of a martensite fraction and a bainite fraction is at least 90%, or the micro-structure contains at least 60%, in terms of volume fraction, of martensite transformed from an un-recrystallized austenite having an apparent mean austenite grain size (dγ) of not greater than 10 μm and the sum of a martensite fraction and a bainite fraction is at least 90%.

To achieve the objects described above, a weldable high strength steel having a low temperature toughness according to the present invention contains the following compositions, in terms of wt %:

C: 0.05 to 0.10%, Si≦0.6%,
Mn: 1.7 to 2.5%, P≦0.015%,
S:≦0.003%, Ni: 0.1 to 1.0%,
Mo: 0.15 to 0.60%, Nb: 0.01 to 0.10%,
Ti: 0.005 to 0.030%, Al: ≦0.06%, and
N: 0.001 to 0.006%.

The present invention provides a high strength steel containing the components described above as the basic chemical compositions so as to secure the required low temperature toughness and weldability. In order to improve various required characteristics, particularly hardenability, the steel further contains 0.0003 to 0.0020% of B in addition to the basic chemical compositions described above, and to improve the strength and the low temperature toughness, the steel further contains 0.1 to 1.2% of Cu. Furthermore, at least one of V: 0.01 to 0.10% and Cr: 0.1 to 0.8% is added so as to refine the steel micro-structure, to increase the toughness and to further improve the welding and HAZ characteristics.

At least one of Ca: 0.001 to 0.006%, REM: 0.001 to 0.02% and Mg: 0.001 to 0.006% is added so as to control the shapes of inclusions such as sulfides and to secure the low temperature toughness.

The terms "martensite" and "bainite" used herein represent not only martensite and bainite themselves but include so-called "tempered martensite" and "tempered bainite" obtained by tempering them, respectively.

BEST MODE FOR CARRYING OUT THE INVENTION

Figure 1:
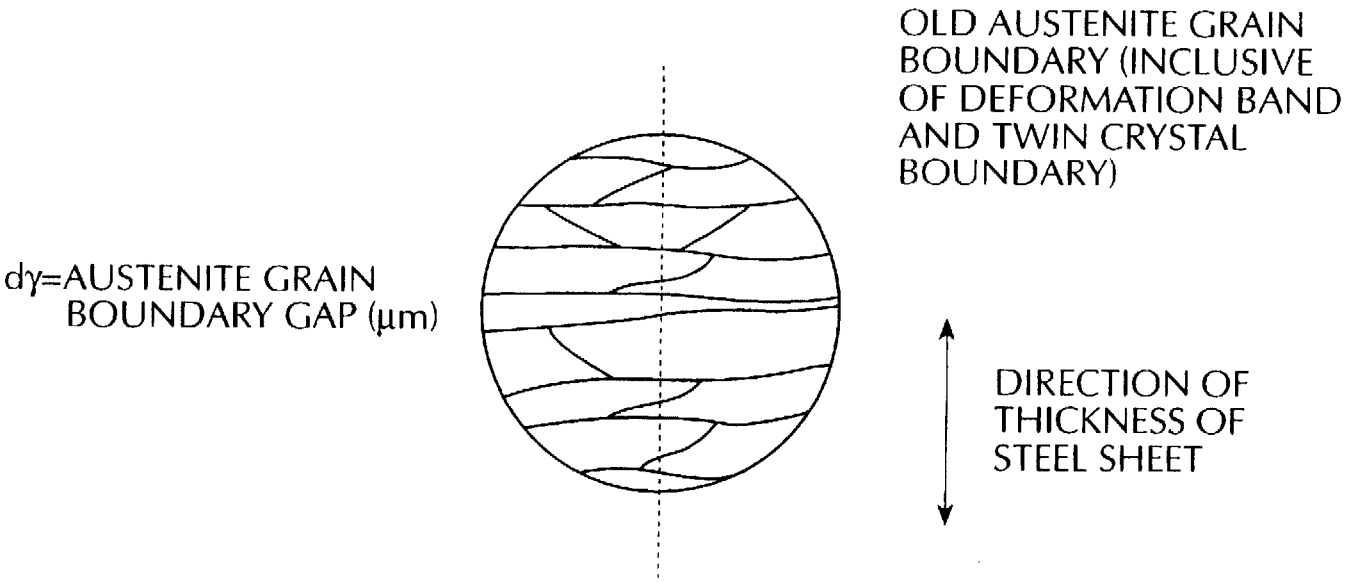
FIG. 1 shows the definition of an apparent mean austenite grain size (dγ).

The first characterizing feature of the present invention resides in that (1) the steel is a low carbon high Mn type (at least 1.7%) steel to which Ni—Nb—Mo-trace Ti are compositely added, and (2) its micro-structure comprises fine martensite transformed from an un-recrystallized austenite having a mean austenite grain size (dγ) of not greater than 10 μm and bainite.

A low carbon-high Mn—Nb—Mo steel has been well known in the past as a line pipe steel having a fine acicular structure, but the upper limit of its tensile strength is 750 MPa at the highest. In this basic chemical compositions, an ultra-high tension steel having a fine is tempered martensite/bainite mixed structure does not exist. It has been believed that a tensile strength higher than 950 MPa can never be attained in the tempered martensite/bainite structure of the Nb—Mo steel, and moreover, that the low temperature toughness and field weldability are insufficient, too.

First, the micro-structure of the steel according to the present invention will be explained.

To accomplish a ultra-high strength of a tensile strength of at least 950 MPa, the micro-structure of the steel material must comprise a predetermined amount of martensite, and its fraction must be at least 60%. If the martensite fraction is not greater than 60%, a sufficient strength cannot be obtained and moreover, it becomes difficult to secure an excellent low temperature toughness (the most desirable martensite fraction for the strength and the low temperature toughness is 70 to 90%). However, the intended strength/low temperature toughness cannot be accomplished even when the martensite fraction is at least 60%, if the remaining structure is not suitable. Therefore, the sum of the martensite fraction and the bainite fraction must be at least 90%.

Even when the kind of micro-structure is limited as described above, excellent low temperature toughness cannot always be obtained. To obtain excellent low temperature toughness, it is necessary to optimize the austenite structure before the γ-to-α transformation (prior austenite structure), and to effectively refine the final structure of the steel material. For this reason, the present invention limits the prior austenite structure to the un-recrystallized austenite and its mean grain size (dγ) to not greater than 10 μm. It has been found that an excellent balance of strength and low temperature toughness can be obtained even in the mixed structure of martensite and bainite in the Nb—Mo steel whose low temperature toughness has been believed inferior in the past, by such limitations.

The reduction of the un-recrystallized austenite grain size into a fine grain size is particularly effective for improving the low temperature toughness of the Nb—Mo type steel according to the present invention. To obtain the intended low temperature toughness (for example, not higher than −80° C. by a transition temperature of a V-notch Charpy impact test), the mean grain size must be smaller than 10 μm. Here, the apparent mean austenite grain size is defined as shown in FIG. 1, and a deformation band and a twin boundary having similar functions to those of the austenite grain boundary are included in the measurement of the austenite grain size. More concretely, the full length of the straight line drawn in the direction of thickness of a steel plate is divided by the number of points of intersection with the austenite grain boundary existing of this straight line to determine dγ. It has been found out that the austenite mean grain size so determined has an extremely close correlation with the low temperature toughness (transition temperature of the Charpy impact test).

It has been also clarified that when the chemical compositions (addition of high Mn—Nb-high Mo) of the steel material and its micro-structure (un-recrystallization of austenite) are strictly controlled as described above, a separation occurs on the fracture of the Charpy impact test, etc., and a fracture area transition temperature can be further improved. The separation is a laminar peel phenomenon occurring on the fracture of the Charpy impact test etc., parallel to the plate surface, and is believed to lower the degree of a triaxial stress at a brittle crack tip and to improve brittle crack propagation stopping characteristics.

The second characterizing feature of the present invention is that (1) the steel is a low carbon-high Mn type steel to which Ni—Mo—Nb-trace B-trace Ti are compositely added, and (2) and its micro-structure mainly comprises a fine martensite structure transformed from un-recrystallized austenite having a mean austenite grain size (dγ) of not greater than 10 μm.

The third characterizing feature of the present invention is that (1) the steel is a low carbon high Mn type (at least 1.7%) Cu precipitation hardening steel which contains 0.8 to 1.2% of Cu and to which Ni—Nb—Cu—Mo-trace Ti are compositely added, and (2) its micro-structure comprises fine martensite and bainite transformed from un-recrystallized austenite having a mean austenite grain size of not greater than 10 μm.

Cu precipitation hardening type steels have been used in the past for high strength steels (tensile strength of a 784 MPa class) for pressure containers, but no example of development in an ultra-high strength line pipe of higher than X100 has been found. This is presumably because the Cu precipitation hardening steel can easily obtain the strength but its low temperature toughness is not sufficient for the line pipe.

As to the low temperature toughness, propagation stopping characteristics are extremely important together with the occurrence characteristics of brittle rupture in the pipe lines. In the conventional Cu precipitation hardening steel, the occurrence characteristics of the brittle rupture typified by the Charpy characteristics are considerably satisfactory, but the stop characteristics of the brittle rupture are not sufficient. For, (1) refining of the micro-structure is not sufficient, and (2) the so-called "separation" occurring on the fracture of Charpy impact test is not utilized. (This separation is a laminar peel phenomenon occurring on the fracture of the Charpy impact test, etc., parallel to the plate surface, and is believed to lower the degree of the triaxial stress at the distal end of the brittle crack and to improve the brittle crack propagation stopping characteristics).

However, even when the kind of the micro-structure is limited as described above, a satisfactory low temperature toughness cannot always be obtained. To obtain the excellent low temperature toughness, it is necessary to optimize the austenite structure before the γ-to-α transformation and to effectively refine the final structure of the steel material.

Therefore, the present invention limits the prior austenite structure to the un-recrystallized austenite and its mean grain size (dγ) to not greater than 10 μm. It has been found out in this way that an extremely excellent balance of the strength and the low temperature toughness can be obtained even in the mixed structure of martensite and bainite of the Nb-Cu steel whose low temperature toughness had been believed to be inferior in the past.

Refining of the un-recrystallized austenite grain size is particularly effective for improving the low temperature toughness of the Nb-Cu type steel of the present invention. To obtain the intended low temperature toughness (a transition temperature of not higher than −80° C. in the V-notch Charpy impact test), the mean grain size must be smaller than 10 μm. Here, the apparent mean austenite grain size is defined as shown in FIG. 1, and the transformation band and the twin boundary having the similar functions to those of the austenite grain boundary are included in the measurement of the austenite grain size. More concretely, the full length of the straight line drawn in the direction of thickness of the steel plate is divided by the number of intersections with the austenite grain boundary existing on the straight line to determine dγ. It has been found out that the mean austenite grain size determined in this way has an extremely close correlationship with the low temperature toughness (transition temperature of the Charpy impact test).

It has been also clarified that when the chemical compositions of the steel material (addition of high Mn—Nb—Mo—Cu) and the form of the micro-structure (un-recrystallization of austenite) are strictly controlled as described above, the separation occurs on the fracture of the Charpy impact test, etc., and the fracture transition temperature can be further improved.

To accomplish an ultra-high strength of a tensile strength of at least 950 MPa, the micro-structure of the steel must comprise a predetermined amount of martensite, and its fraction must be at least 90%. If the martensite fraction is smaller than 90%, a sufficient strength cannot be obtained, and moreover, it becomes difficult to secure a satisfactory low temperature toughness.

However, even when the micro-structure of the steel is strictly controlled as described above, the steel material having the intended characteristics cannot be obtained. To accomplish this object, the chemical compositions must be limited simultaneously with the micro-structure.

Hereinafter, the reasons for limitation of the chemical compositional elements will be explained.

The C content is limited to 0.05 to 0.10%. Carbon is extremely effective for improving the strength of the steel, and at least 0.05% of C is necessary so as to obtain the target strength in the martensite structure. If the C content is too great, however, the low temperature toughness of both the base metal and the HAZ and field weldability are remarkably deteriorated. Therefore, the upper limit of C is set to 0.10%. Preferably, however, the upper limit value is limited to 0.08%.

Si is added for deoxidation and for improving the strength. If its addition amount is too great, however, the HAZ toughness and field weldability are remarkably deteriorated. Therefore, its upper limit is set to 0.6%. Deoxidation of the steel can be attained sufficiently by Al or Ti, and Si need not always be added.

Mn is an indispensable element for converting the micro-structure of the steel of the present invention to a structure mainly comprising martensite and for securing the excellent balance between strength and low temperature toughness, and its lower limit is 1.7%. If the addition amount of Mn is too high, however, hardenability of the steel increases, so that not only the HAZ toughness and field weldability are deteriorated, but center segregation of a continuous cast slab is promoted and the low temperature toughness of the base metal is deteriorated, too. Therefore, the upper limit is set to 2.5%.

The object of addition of Ni is to improve the low carbon steel of the present invention without deteriorating the low temperature toughness and field weldability. In comparison with the addition of Cr and Mo, the addition of Ni results in less formation of the hardened structure in the rolled structure (particularly, the center segregation band of the continuous cast slab), which is detrimental to the low temperature toughness, and it has been found out further that the addition of a small amount of Ni of at least 0.1% is effective for improving the HAZ toughness, too. (From the aspect of the HAZ toughness, a particularly effective amount of addition of Ni is at least 0.3%). If the addition amount is too high, however, not only economy but also the HAZ toughness and field weldability are deteriorated. Therefore, its upper limit is set to 1.0%. The addition of Ni is also effective for preventing the Cu crack during continuous casting and during hot rolling. In this case, Ni must be added in an amount at least ⅓ of the Cu amount.

Mo is added so as to improve hardenability of the steel and to obtain the intended structure mainly comprising martensite. In B-containing steels, a effect of Mo on the hardenability increases, and the multiple of Mo in the later-appearing P value becomes 2 in the B steel in comparison with 1 in the B-free steel. Therefore, the addition of Mo is particularly effective in the B-containing steels. When co-present with Nb, Mo supresses recrystallization of austenite during controlled rolling, and is also effective for refining the austenite structure. To obtain such effects, at least 0.15% of Mo is necessary. However, the addition of Mo in an excessive amount causes deterioration of the HAZ toughness and field weldability and furthermore, extinguishes the hardenability improving effect of B. Therefore, its upper limit is set to 0.6%.

Further, the steel according to the present invention contains 0.01 to 0.10% of Nb and 0.005 to 0.030% of Ti as the indispensable elements. When co-present with Mo, Nb not only surpresses recrystallization of austenite during controlled rolling to thereby refine the structure, but makes a great contribution to precipitation hardening and the increase of hardenability, and makes the steel tougher. Particularly when Nb and B are co-present, the hardenability improvement effect can be increased synergistically. However, if the addition amount of Nb is too high, the HAZ toughness and field weldability are adversely affected. Therefore, its upper limit is set to 0.10%. On the other hand, the addition of Ti forms TiN, supresses coarsening of the austenite grain during reheating and the austenite grains of the HAZ, refines the micro-structure and improves the low temperature toughness of both the base metal and the HAZ. It also has the function of fixing solid solution N, which is detrimental to the hardenability improvement effect of B, as TiN. For this purpose, at least 3.4N (wt %) of Ti is preferably added. When the Al content is small (such as not greater than 0.005%), Ti forms an oxide, functions as an intra-grain ferrite formation nucleus in the HAZ, and refines the HAZ structure. In order to cause TiN to exhibit such effects, at least 0.005% of Ti must be added. If the Ti content is too high, coarsening of TiN and precipitation hardening due to TiC occur and the low temperature toughness gets deteriorated. Therefore, its upper limit is set to 0.03%.

Al is ordinarily contained as a deoxidation agent in the steel, and has also the effect of refining the structure. If the Al content exceeds 0.06%, however, alumina type nonmetallic inclusions increase and spoil the cleanness of the steel. Therefore, its upper limit is set to 0.06%. Deoxidation can be accomplished by Ti or Si, and Al need not be always added.

N forms TiN, supresses coarsening of the austenite grains during reheating of the slab and the austenite grains of the HAZ, and improves the low temperature toughness of both the base metal and the HAZ. The minimum necessary amount for this purpose is 0.001%. If the N content is too high, however, N results in surface defects on the slab, deterioration of the HAZ toughness and a drop in the hardenability improvement effect of B. Therefore, its upper limit must be limited to 0.006%.

In the present invention, the P and S content as the impurity elements are set to 0.015% and 0.003%, respectively. The main reason is to further improve the low temperature toughness of both the base metal and the HAZ. The reduction of the P content reduces center segregation of the continuous cast slab, prevents the grain boundary cracking and improves the low temperature toughness. The reduction of the S content reduces MnS, which is elongated by hot rolling, and improves the ductility and the toughness.

Next, the object of the addition of B, Cu, Cr and V will be explained.

The main object of the addition of these elements besides the basic chemical compositions is to further improve the strength and the toughness and to enlarge the sizes of steel materials that can be produced, without spoiling the excellent features of the present invention. Therefore, the addition amounts of these elements should be naturally limited.

An extremely small amount of B drastically improves hardenability of the steel. Therefore, B is an essentially indispensable element in the steel of the present invention. It has an effect corresponding to a value 1 in the later-appearing P value, that is, 1% Mn. Further, B enhances the hardenability improvement effect of Mo, and synergistically improves hardenability when copresent with Nb. To obtain such effects, at least 0.0003% of B is necessary. When added in an excessive amount, on the other hand, B not only deteriorates the low temperature toughness but extinguishes, in some cases, the hardenability improvement effect of B. Therefore, its upper limit is set to 0.0020%.

The object of the addition of Cu is to improve the strength of the low carbon steel of the present invention without deteriorating the low temperature toughness. When compared with the addition of Mn, Cr and Mo, the addition of Cu does not form a hardened structure, which is detrimental to the low temperature toughness, in the rolled structure (particularly, in the center segregation band of the slab), and is found to increase the strength. When added in an excessive amount, however, Cu deteriorates field weldability and the HAZ toughness. Therefore, its upper limit is set to 1.2%.

Cu increases the strength of both the base metal and the weld portion, but when its addition amount is too high, the HAZ toughness and field weldability are remarkably deteriorated. Therefore, the upper limit of the Cr content is 0.8%.

V has substantially the same effect as Nb, but its effect is weaker than that of Nb. However, the effect of the addition of V in the ultra-high strength steel is high, and the composite addition of Nb and V makes the excellent features of the steel of the present invention all the more remarkable. The addition amount of up to 0.10% is permissible from the aspect of the HAZ toughness and field weldability, and a particularly preferred range of the addition amount is from 0.03 to 0.08%.

Further, the object of the addition of Ca, REM and Mg will be explained.

Ca and REM control the form of the sulfide (MnS) and improve the low temperature toughness (the increase of absorption energy in the Charpy test, etc.). If the Ca or REM content is not greater than 0.001%, however, no practical effect can be obtained, and if the Ca content exceeds 0.006% or if the REM content exceeds 0.02%, large quantities of CaO—CaS or REM—CaS are formed and are converted to large clusters and large inclusions, and they not only spoil cleanness of the steel but also exert adverse influences on field weldability. Therefore, the upper limit of the Ca addition amount is limited to 0.006% or the upper limit of the REM addition amount is limited to 0.02%. By the way, it is particularly effective in ultra-high strength line pipes to reduce the S and O contents to 0.001% and 0.002%, respectively, and to set the relation $ESSP=(Ca)[1-124(O)]/1.25S$ to $0.5 \leqq ESSP \leqq 10.0$.

Mg forms a finely dispersed oxide, supresses coarsening of the grains at the welding heat affected zone and improves the toughness. If the amount of addition is less than 0.001%, the improvement of the toughness cannot be observed, and if it exceeds 0.006%, coarse oxides are formed, and the toughness is deteriorated.

In addition to the limitation of the individual addition elements described above, the present invention limits the afore-mentioned P value, that is, $P=2.7C+0.4Si+Mn+0.8Cr+0.45(Ni+Cu)+(1-\beta)Mo+V-1+\beta$, to $1.9 \leqq P \leqq 4$. By the way, $\beta$ takes a value 0 when B<3 ppm and a value 1 when B≧3 ppm. This is to accomplish the intended balance between the strength and the low temperature toughness. The reason why the lower limit of the P value is set to 1.9 is to obtain a strength of at least 950 MPa and an excellent low temperature toughness. The upper limit of the P value is limited to 4.0 in order to maintain the excellent HAZ toughness and field weldability.

When the high strength steel having excellent low temperature toughness according to the present invention is produced, the following production method is preferably employed.

After a steel slab having the chemical compositions of the present invention is reheated to a temperature within the range of 950° to 1,300° C., the slab is hot rolled so that a cumulative rolling reduction amount at a temperature not higher than 950° C. is at least 50% and a hot rolling finish temperature is not lower than 800° C. Next, cooling is carried out at a cooling rate of at least 10° C./sec down to an arbitrary temperature below 500° C. Tempering is carried out, whenever necessary, at a temperature below an $Ac_1$ point.

The lower limit of the reheating temperature of the steel slab is determined so that solid solution of the elements can be accomplished sufficiently, and the upper limit is determined by the condition under which coarsening of the crystal grains does not become remarkable.

The temperature below 950° C. represents an un-recrystallization temperature zone, and in order to obtain the intended fine grain size, a cumulative rolling reduction quantity of at least 50% is necessary. The finish hot-rolling temperature is limited to not lower than 800° C. at which bainite is not formed. Thereafter, cooling is carried out at a cooling rate of at least 10° C./sec so as to form the martensite and bainite structure. Since transformation finishes substantially at 500° C., cooling is made to a temperature below 500° C.

Furthermore, tempering treatment can be carried out in the steel of the present invention at a temperature below the $Ac_1$ point. This tempering treatment can suitably recover the ductility and the toughness. The tempering treatment does not change the micro-structure fraction itself, does not spoil the excellent features of the present invention and has the effect of narrowing the softening width of the welding heat affected zone.

Next, Examples of the present invention will be described.

EXAMPLE 1

Slabs having various chemical compositions were produced by melting on a laboratory scale (50 kg, 120 mm-thick ingot) or a converter continuous-casting method (240 mm-thick). These slabs were hot-rolled into steel plates having a thickness of 15 to 28 mm under various conditions. The mechanical properties of each of the steel plates so rolled and its micro-structure, were examined.

The mechanical properties (yield strength: YS, tensile strength: TS, absorption energy at −40° C. in the Charpy impact test: $vE_{-40}$ and transition temperature: vTrs) of the steel plates were measured in a direction orthogonal to the rolling direction. The HAZ toughness (absorption energy at −20° C. in the Charpy impact test: $vE_{-20}$) was evaluated by the simulated HAZ specimens (maximum heating temperature: 1,400° C., cooling time from 800° to 500° C.: [$\Delta t_{800-500}$]: 25 seconds). Field weldability was evaluated as the lowest preheating temperature necessary for preventing the low temperature cracks of the HAZ by the y-slit weld crack test (JIS G3158) (welding method: gas metal arc welding, welding rod: tensile strength of 100 MPa, heat input: 0.5 kJ/mm, hydrogen content of welding metal: 3 cc/100 g).

Tables 1 and 2 show the Examples. The steel plates produced in accordance with the present invention had the excellent balance of the strength and the low temperature toughness, the HAZ toughness and field weldability. In contrast, Comparative Examples were remarkably inferior in their characteristics because the chemical compositions or their micro-structures were not suitable.

Because the C content was too great in Steel No. 9, the Charpy absorbed energy of the base metal and the HAZ was low, and the preheating temperature at the time of welding was also high. Because Ni was not added in Steel No. 10, the low temperature toughness of the base metal and the HAZ was inferior. Because the Mn addition amount and the P value were too great in Steel No. 11, the low temperature toughness of the base metal and the HAZ was inferior, and the preheating temperature at the time of welding was also extremely high.

Because Nb was not added in Steel No. 12, the strength was insufficient, the austenite grain size was large, and the toughness of the base metal was inferior.

TABLE 1

| | | chemical compositions (wt %, *ppm) | | | | | | | | | | | | | steel plate thick- |
|---|---|---|---|---|---|---|---|---|---|---|---|---|---|---|---|
| section | steel | C | Si | Mn | P* | S* | Ni | Mo | Nb | Ti | Al | N* | others | P value | ness (mm) |
| steel of this invention | 1 | 0.058 | 0.26 | 2.37 | 100 | 15 | 0.40 | 0.43 | 0.041 | 0.009 | 0.027 | 23 | | 2.24 | 15 |
| | 2 | 0.093 | 0.32 | 1.89 | 60 | 8 | 0.48 | 0.57 | 0.024 | 0.012 | 0.018 | 40 | Mg:0.002 | 1.96 | 20 |
| | 3 | 0.064 | 0.18 | 2.15 | 70 | 3 | 0.24 | 0.38 | 0.017 | 0.021 | 0.024 | 56 | Cr:0.34 | 2.16 | 20 |
| | 4 | 0.070 | 0.27 | 2.10 | 50 | 7 | 0.34 | 0.51 | 0.038 | 0.015 | 0.027 | 38 | Cu:0.39 | 2.24 | 20 |
| | 5 | 0.073 | 0.23 | 2.24 | 120 | 18 | 0.18 | 0.46 | 0.041 | 0.016 | 0.034 | 27 | V:0.05 | 2.12 | 20 |
| | 6 | 0.067 | 0.02 | 2.13 | 80 | 6 | 0.36 | 0.47 | 0.132 | 0.015 | 0.019 | 37 | V:0.06, Cu:0.41 | 2.20 | 20 |
| | 7 | 0.075 | 0.27 | 2.01 | 60 | 10 | 0.35 | 0.45 | 0.038 | 0.016 | 0.002 | 33 | V:0.07, Cu:0.37 Cr:0.58 | 2.54 | 22 |
| | 8 | 0.072 | 0.12 | 2.03 | 70 | 5 | 0.52 | 0.43 | 0.038 | 0.017 | 0.028 | 35 | V:0.07, Cu:0.53 Ca:0.0021 | 2.24 | 28 |
| Comparative Steels | 9 | 0.117 | 0.26 | 2.01 | 80 | 15 | 0.37 | 0.38 | 0.032 | 0.015 | 0.021 | 29 | | 1.98 | 15 |
| | 10 | 0.076 | 0.21 | 2.16 | 50 | 7 | — | 0.46 | 0.046 | 0.014 | 0.031 | 36 | Cu:0.32 | 2.05 | 20 |
| | 11 | 0.079 | 0.28 | 2.62 | 60 | 5 | 0.38 | 0.42 | 0.039 | 0.015 | 0.028 | 42 | Cr:0.38 | 2.84 | 20 |
| | 12 | 0.072 | 0.27 | 2.08 | 70 | 5 | 0.37 | 0.46 | 0.004 | 0.018 | 0.025 | 29 | | 2.01 | 20 |

TABLE 2

| | | | micro-structure | | | mechanical properties | | | | HAZ | |
|---|---|---|---|---|---|---|---|---|---|---|---|
| section | steel | tempering treatment | austenite mean grain size (μm) | martensite fraction (%) | martensite/bainite fraction (%) | YS (N/mm²) | TS (N/mm²) | $vE_{-40}$ (J) | vTrs (°C.) | toughness $vE_{-20}$ (J) | field weldability lowest preheating temperature (°C.) |
| steel of this invention | 1 | ○ | 5.3 | 97 | 100 | 892 | 1025 | 234 | −100 | 213 | preheating not necessary |
| | 1' | x | 5.3 | 97 | 100 | 845 | 1081 | 211 | −95 | 213 | preheating not necessary |
| | 2 | ○ | 7.6 | 79 | 97 | 918 | 1076 | 208 | −85 | 187 | preheating not necessary |
| | 3 | ○ | 8.2 | 94 | 100 | 872 | 978 | 217 | −95 | 159 | preheating not necessary |
| | 3' | x | 8.2 | 79 | 97 | 863 | 1122 | 195 | −80 | 187 | preheating not necessary |
| | 4 | ○ | 7.3 | 96 | 100 | 869 | 981 | 302 | −120 | 202 | preheating not necessary |

TABLE 2-continued

| | | | micro-structure | | | mechanical properties | | | | HAZ | |
|---|---|---|---|---|---|---|---|---|---|---|---|
| section | steel | tempering treatment | austenite mean grain size (μm) | martensite fraction (%) | martensite/bainite fraction (%) | YS (N/mm²) | TS (N/mm²) | $vE_{-40}$ (J) | vTrs (°C.) | toughness $vE_{-20}$ (J) | field weldability lowest preheating temperature (°C.) |
| | 5 | ○ | 7.1 | 91 | 100 | 903 | 1018 | 231 | −110 | 167 | preheating not necessary |
| | 6 | ○ | 6.7 | 89 | 100 | 884 | 979 | 302 | −110 | 320 | preheating not necessary |
| | 7 | ○ | 7.4 | 83 | 100 | 874 | 984 | 276 | −105 | 307 | preheating not necessary |
| | 7' | x | 7.4 | 83 | 100 | 821 | 1030 | 265 | −95 | 307 | preheating not necessary |
| | 8 | ○ | 8.9 | 75 | 100 | 862 | 970 | 285 | −110 | 243 | preheating not necessary |
| Comparative Steels | 9 | | 6.9 | 89 | 100 | 926 | 1098 | 124 | −80 | 56 | 100 |
| | 10 | | 7.2 | 93 | 100 | 856 | 973 | 78 | −55 | 73 | preheating not necessary |
| | 11 | | 6.6 | 100 | 100 | 967 | 1127 | 34 | −60 | 20 | 150 |
| | 12 | | 12.8 | 87 | 93 | 798 | 894 | 37 | −50 | 256 | preheating not necessary |

EXAMPLE 2

Slabs having various chemical compositions components were produced by melting on a laboratory scale (50 kg, 100 mm-thick ingots) or by a converter-continuous casting method (240 mm-thick). These slabs were hot-rolled to steel plates having a plate thickness of 15 to 25 mm under various conditions. Various properties of the steel plates so rolled and their micro-structures were examined. The mechanical properties (yield strength: YS, tensile strength: TS, absorption energy at −40° C. in the Charpy test: $vE_{-40}$, and 50% fracture transition temperature: vTrs) were examined in a direction orthogonal to the rolling direction. The HAZ toughness (absorption energy at −40° C. in the Charpy test: $vE_{-40}$) was evaluated by the simulated HAZ specimens (maximum heating temperature: 1,400° C., cooling time from 800° to 500° C. [$\Delta t_{800-500}$]: 25 seconds). Field weldability was evaluated by the lowest preheating temperature necessary for preventing the low temperature crack of the HAZ in the y-slit weld crack test (JIS G3158) (welding method: gas metal arc welding, welding rod: tensile strength of 100 MPa, heat input: 0.3 kJ/mm, hydrogen amount of weld metal: 3 cc/100 g metal).

Tables 1 and 2 show the Examples. The steel plates produced in accordance with the method of the present invention exhibited the excellent balance between the strength and the low temperature toughness, the HAZ toughness and field weldability. In contrast, Comparative Steels were obviously and remarkably inferior in any of their characteristics because the chemical compositions or the micro-structures were not suitable.

EXAMPLE 3

Slabs having various chemical compositions were produced by melting on a laboratory scale (50 kg, 120 mm-thick) or a converter-continuous casting method (240 mm-thick). These slabs were hot-rolled to steel plates having a plate thickness of 15 to 30 mm under various conditions. Various properties of the steel plates so rolled and their micro-structures were examined.

The mechanical properties (yield strength: YS, tensile strength: TS, absorption energy at −40° C. in the Charpy impact test: $vE_{-40}$ and transition temperature: vTrs) were examined in a direction rothogonal to the rolling direction.

The HAZ toughness (absorption energy at −20° C. in the Charpy impact test: $vE_{-20}$) was evaluated by the simulated HAZ specimens (maximum heating temperature: 1,400° C., cooling time from 800° to 500° C. [$\Delta t_{800-500}$]: 25 seconds).

Field weldability was evaluated by the lowest preheating temperature necessary for preventing the low temperature crack of the HAZ in the y-slit weld crack test (JIS G3158) (welding method: gas metal arc welding, welding rod: tensile strength of 100 MPa, heat input: 0.5 kJ/mm, hydrogen amount of weld metal: 3 cc/100 g).

Examples are shown in Tables 1 and 2. The steel plates produced in accordance with the present invention exhibited the excellent balance of the strength and the toughness, the HAZ toughness and field weldability. In contrast, Comparative Steels were remarkably inferior in any of their characteristics because the chemical compositions or the micro-structures were not suitable.

Because the C content was too high in Steel No. 9, Charpy absorption energy of the base metal and the HAZ was low, and the preheating temperature at the time of welding was high, too. Because the Mn and P contents were too high in Steel No. 10, the low temperature of both the base metal and the HAZ was inferior, and the preheating temperature at the time of welding was high, too.

Because the S content was too high in Steel No. 11, absorption energy of the base metal and the HAZ was low.

INDUSTRIAL APPLICABILITY

According to the present invention, it becomes possible to stably produce large quantities of steels for an ultra-high strength line pipes (tensile strength of at least 950 MPa and exceeding X100 of the API standard) having excellent low temperature toughness and field weldability. As a result, safety of the piplines can be remarkably improved, and transportation efficiency of the pipelines and execution efficiency can be drastically improved.

TABLE 3 chemical compositions of steels (wt %)

| section | steel | C | Si | Mn | P | S | Ni | Mo | Nb | T | B | Al | N | others | P value |
|---|---|---|---|---|---|---|---|---|---|---|---|---|---|---|---|
| steel | 1 | 0.06 | 0.24 | 1.95 | 0.003 | 0.001 | 0.36 | 0.35 | 0.031 | 0.012 | 0.0007 | 0.024 | 0.0027 | | 3.07 |
| of | 2 | 0.07 | 0.05 | 1.76 | 0.012 | 0.002 | 0.78 | 0.35 | 0.015 | 0.015 | 0.0012 | 0.006 | 0.0035 | Cu: 0.60 | 3.29 |
| this | 3 | 0.05 | 0.31 | 2.12 | 0.009 | 0.002 | 0.81 | 0.24 | 0.035 | 0.017 | 0.0010 | 0.006 | 0.0041 | Cr: 0.5 | 3.62 |
| in- | 4 | 0.08 | 0.17 | 2.02 | 0.014 | 0.001 | 0.45 | 0.45 | 0.018 | 0.013 | 0.0005 | 0.038 | 0.0027 | V: 0.06 | 3.41 |
| ven- | 5 | 0.06 | 0.40 | 2.13 | 0.006 | 0.003 | 0.25 | 0.38 | 0.024 | 0.021 | 0.0015 | 0.019 | 0.0022 | Ca: 0.004 | 3.32 |
| tion | 6 | 0.06 | 0.23 | 2.17 | 0.008 | 0.001 | 0.37 | 0.21 | 0.032 | 0.012 | 0.0009 | 0.045 | 0.0048 | | 3.01 |
| | 7 | 0.07 | 0.01 | 1.87 | 0.012 | 0.002 | 0.60 | 0.20 | 0.027 | 0.014 | 0.0013 | 0.011 | 0.0029 | Cr: 0.3, Cu: 0.3 | 3.11 |
| | 8 | 0.09 | 0.26 | 1.96 | 0.005 | 0.001 | 0.37 | 0.33 | 0.030 | 0.018 | 0.0008 | 0.033 | 0.0021 | | 3.13 |
| Com- | 9 | 0.07 | 0.28 | 1.94 | 0.004 | 0.002 | 0.40 | 0.38 | 0.033 | 0.012 | 0.0030 | 0.029 | 0.0035 | | 3.18 |
| para- | 10 | 0.06 | 0.25 | 1.96 | 0.008 | 0.001 | 0.21 | 0.75 | 0.036 | 0.013 | 0.0014 | 0.030 | 0.0032 | | 3.82 |
| tive | 11 | 0.06 | 0.18 | 1.60 | 0.010 | 0.001 | 0.38 | 0.22 | 0.037 | 0.020 | 0.0011 | 0.043 | 0.0035 | Cu: 0.4 | 2.63 |
| Steels | 12 | 0.08 | 0.31 | 2.53 | 0.008 | 0.001 | 0.86 | 0.32 | 0.035 | 0.024 | 0.0013 | 0.035 | 0.0034 | | 3.90 |

TABLE 4

| | | plate | | micro-structure | | mechanical properties | | | | HAZ toughness | field weldability lowest preheating |
|---|---|---|---|---|---|---|---|---|---|---|---|
| section | steel | thickness (mm) | tempering °C. × min. | dy (μm) | martensite ratio (%) | YS (MPa) | TS (MPa) | $vE_{-40}$ (J) | vTrs (°C.) | $vE_{-20}$ (J) | temp. (°C.) |
| steel of this invention | 1 | 20 | — | 7.3 | 97 | 831 | 1163 | 204 | −100 | 175 | preheating not necessary |
| | 1 | 20 | 550 | 7.3 | 97 | 966 | 993 | 218 | −120 | 176 | preheating not necessary |
| | 2 | 20 | — | 5.1 | 95 | 835 | 1147 | 205 | −110 | 174 | preheating not necessary |
| | 3 | 25 | 550 | 8.5 | 92 | 903 | 1002 | 221 | −95 | 198 | preheating not necessary |
| | 4 | 25 | 550 | 7.9 | 92 | 878 | 995 | 204 | −100 | 168 | preheating not necessary |
| | 5 | 20 | — | 6.6 | 94 | 855 | 1171 | 205 | 105 | 173 | preheating not necessary |
| | 6 | 16 | — | 5.4 | 98 | 819 | 1158 | 207 | −130 | 184 | preheating not necessary |
| | 6 | 16 | 550 | 5.4 | 98 | 877 | 1110 | 206 | −95 | 187 | preheating not necessary |
| | 7 | 20 | — | 7.8 | 93 | 842 | 1135 | 223 | −95 | 179 | preheating not necessary |
| | 8 | 20 | 550 | 8.2 | 91 | 1001 | 1089 | 186 | 85 | 158 | preheating not necessary |
| Comparative Steels | 6 | 20 | — | 14.6 | 96 | 799 | 1162 | 210 | −65 | 183 | preheating not necessary |
| | 6 | 20 | — | 7.5 | 74 | 797 | 910 | 205 | −70 | 179 | preheating |
| | 9 | 20 | 550 | 8.2 | 93 | 862 | 978 | 141 | −50 | 33 | preheating not necessary |
| | 10 | 20 | 550 | 7.9 | 94 | 1033 | 1154 | 159 | −60 | 45 | preheating not necessary |
| | 11 | 20 | — | 6.7 | 91 | 797 | 897 | 193 | −75 | 152 | preheating not necessary |
| | 12 | 20 | — | 7.3 | 95 | 1024 | 1180 | 176 | −80 | 37 | 80 |

TABLE 5

| section | steel | chemical compositions (wt %, *ppm) C | Si | Mn | P* | S* | Ni | Cu | Mo | Nb | Ti | Al | N* | others | P value |
|---|---|---|---|---|---|---|---|---|---|---|---|---|---|---|---|
| steel | 1 | 0.060 | 0.29 | 1.96 | 120 | 20 | 0.42 | 0.98 | 0.42 | 0.040 | 0.012 | 0.030 | 33 | | 2.29 |
| of this | 2 | 0.090 | 0.35 | 1.72 | 65 | 18 | 0.50 | 1.07 | 0.50 | 0.026 | 0.015 | 0.020 | 45 | REM: 0.008 | 2.31 |
| invention | 3 | 0.065 | 0.20 | 1.85 | 74 | 13 | 0.36 | 1.01 | 0.40 | 0.020 | 0.024 | 0.026 | 59 | Cr: 0.65 | 2.55 |
| | 4 | 0.070 | 0.29 | 1.82 | 52 | 17 | 0.35 | 1.12 | 0.50 | 0.036 | 0.018 | 0.029 | 48 | | 2.2 |
| | 5 | 0.071 | 0.25 | 1.71 | 128 | 18 | 0.45 | 1.03 | 0.42 | 0.045 | 0.020 | 0.035 | 37 | V: 0.061 | 2.15 |
| | 6 | 0.069 | 0.05 | 1.92 | 84 | 16 | 0.39 | 0.92 | 0.49 | 0.035 | 0.018 | 0.018 | 39 | V: 0.071 | 2.28 |
| | 7 | 0.078 | 0.24 | 1.84 | 65 | 10 | 0.48 | 1.15 | 0.48 | 0.040 | 0.019 | 0.002 | 30 | Cr: 0.38, V: 0.080 | 2.74 |
| | 8 | 0.070 | 0.15 | 1.95 | 78 | 15 | 0.42 | 0.85 | 0.45 | 0.040 | 0.015 | 0.030 | 38 | V: 0.08, Ca: 0.0020 | 2.30 |
| Compar- | 9 | 0.127 | 0.28 | 1.71 | 70 | 18 | 0.39 | 0.93 | 0.39 | 0.030 | 0.018 | 0.024 | 39 | | 2.15 |
| ative | 10 | 0.080 | 0.26 | 2.17 | 160 | 18 | 0.40 | 1.02 | 0.40 | 0.037 | 0.017 | 0.026 | 32 | Cr: 0.40 | 2.85 |
| Steels | 11 | 0.082 | 0.40 | 1.87 | 90 | 53 | 0.42 | 0.98 | 0.45 | 0.039 | 0.018 | 0.032 | 35 | | 2.23 |

TABLE 6

| section | steel | tempering treatment | steel plate thickness (mm) | austenite grain size dy (μm) | M fraction (%) | M + B fraction (%) | mechanical properties YS (MPa) | TS (MPa) | $vE_{-40}$ (J) | vTrs (°C.) | HAZ toughness $vE_{-20}$ (J) | field weldability lowest preheating temp. (°C.) | remarks |
|---|---|---|---|---|---|---|---|---|---|---|---|---|---|
| steel | 1 | ○ | 15 | 5.2 | 65 | 98 | 835 | 940 | 224 | −95 | 193 | preheating not necessary | |
| of this inven- | 1' | x | 15 | 5.2 | 65 | 98 | 801 | 955 | 213 | −85 | 193 | preheating not necessary | |
| tion | 2 | ○ | 20 | 7.4 | 90 | 97 | 918 | 1018 | 216 | −85 | 177 | preheating not necessary | |
| | 3 | ○ | 22 | 8.0 | 74 | 99 | 840 | 1003 | 197 | −90 | 159 | preheating not necessary | |
| | 3' | x | 22 | 8.0 | 74 | 99 | 812 | 1023 | 200 | −85 | 159 | preheating not necessary | |
| | 4 | ○ | 20 | 7.1 | 80 | 92 | 832 | 952 | 204 | −90 | 182 | preheating not necessary | |
| | 5 | ○ | 22 | 6.8 | 82 | 91 | 846 | 970 | 214 | −95 | 157 | preheating not necessary | |
| | 6 | ○ | 20 | 6.2 | 76 | 94 | 852 | 993 | 201 | −85 | 220 | preheating not necessary | |
| | 6' | x | 20 | 6.2 | 76 | 94 | 825 | 999 | 193 | −80 | 220 | preheating not necessary | |
| | 7 | ○ | 25 | 6.4 | 85 | 100 | 906 | 1032 | 216 | −90 | 227 | preheating not necessary | |
| | 8 | ○ | 30 | 5.9 | 70 | 91 | 850 | 990 | 226 | −90 | 213 | preheating not necessary | |
| Compar- | 9 | ○ | 22 | 6.7 | 91 | 100 | 906 | 998 | 98 | −80 | 66 | 80 | |
| ative | 10 | ○ | 24 | 6.1 | 85 | 91 | 947 | 1027 | 54 | −75 | 38 | 125 | |
| Steels | 11 | ○ | 28 | 7.1 | 80 | 98 | 850 | 971 | 107 | −80 | 58 | preheating not necessary | |

We claim:

1. A weldable high strength steel excellent in low temperature toughness; containing, in terms of percent by weight:

C: 0.05 to 0.10%,

Si: ≦0.6%,

Mn: 1.7 to 2.5%,

P: ≦0.015%

S: ≦0.003%

Ni: 0.1 to 1.0%,

Mo: 0.15 to 0.60%,

Nb: 0.01 to 0.10%,

Ti: 0.005 to 0.030%,

Al: ≦0.06%,

B: up to 0.0020%

N: 0.001 to 0.006%, and the balance of Fe and unavoidable impurities; and having a P value, defined by the following formula, within the range of 1.9 to 4.0;

wherein the micro-structure of said steel contains at least 60%, in terms of a volume fraction, of martensite transformed from un-recrystallized austenite having an apparent mean austenite grain size (dγ) of not greater than 10 μm, and the sum of said martensite fraction and a bainite fraction is at least 90%:

$$P=2.7C+0.4Si+Mn+0.8Cr+0.45(Ni+Cu)+(1+\beta)Mo-1+\beta$$

where β is 0 when B is less than 3 ppm and β is 1 when B is greater than or equal to 3 ppm and wherein said steel has a tensile strength of at least 950 MPa.

2. A weldable high strength steel excellent in low temperature toughness, which contains at least one of the following components, in terms of percent by weight, in addition to said steel compositions of claim 1:

B: 0.0003 to 0.0020%,

Cu: 0.1 to 1.2%,

Cr: 0.1 to 0.8%, and

V: 0.01 to 0.10%.

3. A weldable high strength steel excellent in low temperature toughness, which contains at least one of the following components, in terms of percent by weight, in addition to said steel compositions of claims 1;

Ca: 0.001 to 0.006%,

REM: 0.001 to 0.02%, and

Mg: 0.001 to 0.006%.

4. A weldable high strength steel excellent in low temperature toughness, containing, in terms of percent by weight:

C: 0.05 to 0.10%,

Si: ≦0.6%,

Mn: 1.7 to 2.5%,

P: ≦0.015%,

S: ≦0.003%,

Ni: 0.1 to 1.0%,

Mo: 0.15 to 0.60%,

Nb: 0.01 to 0.10%,

Ti: 0.005 to 0.030%,

Al: ≦0.06%,

N: 0.001 to 0.006%,

B: 0.0003 to 0.0020%, and the balance of Fe and unavoidable impurities; and having a P value, defined by the following formula, within the range of 2.5 to 4.0;

wherein the micro-structure of said steel contains at least 60%, in terms of a volume fraction, of martensite transformed from un-recrystallized austenite having an apparent mean austenite grain size (dγ) of not greater than 10 μm, and the sum of said martensite fraction and a bainite fraction is at least 90%:

$$P=2.7C+0.4Si+Mn+0.8Cr+0.45(Ni+Cu)+2MO,$$

and wherein said steel has a tensile strength of at least 950 MPa.

5. A weldable high strength steel excellent in low temperature toughness, which contains at least one of the following compositions, in terms of percent by weight, in addition to said steel compositions of claim 4:

V: 0.01 to 0.10%,

Cu: 0.1 to 1.2%, and

Cr: 0.1 to 0.8%.

6. A weldable high strength steel excellent in low temperature toughness, containing, in terms of percent by weight:

C: 0.05 to 0.10%,

Si: <0.6%,

Mn: 1.7 to 2.0%,

P: <0.015%,

S: <0.003%,

Ni: 0.3 to 1.0%,

Cu: 0.8 to 1.2%,

Mo: 0.35 to 0.50%,

Nb: 0.01 to 0.10%,

Ti: 0.005 to 0.030%,

Al: ≦0.06%,

N: 0.001 to 0.006%, and the balance of Fe and unavoidable impurities; and having a P value, defined by the following formula, within the range of 1.9 to 2.8;

wherein the micro-structure of said steel contains at least 60%, in terms of a volume fraction, of martensite transformed from un-recrystallized austenite having an apparent mean austenite grain size (dγ) of not greater than 10 μm, and the sum of said martensite fraction and a bainite fraction is at least 90%:

$$P=2.7C+0.4Si+Mn+0.8Cr+0.45(Ni+Cu)+Mo+V-1,$$

and wherein said steel has a tensile strength of at least 950 MPa.

7. A weldable high strength steel excellent in low temperature toughness, which contains at least one of the following components, in terms of percent by weight, in addition to said steel compositions according to claim 6:

V: 0.01 to 0.10%, and

Cr:0.1 to 0.8%.

8. A weldable high strength steel excellent in low temperature toughness, which contains at least one of the following components, in terms of percent by weight, in addition to said steel compositions according to any of claim 4:

Ca: 0.001 to 0.006%,

REM: 0.001 to 0.02%, and

Mg: 0.001 to 0.006%.

9. A weldable high strength steel excellent in low temperature toughness, which contains at least one of the following components, in terms of percent by weight, in addition to said steel compositions according to claim 6:

Ca: 0.001 to 0.006%,

REM: 0.001 to 0.02%, and

Mg: 0.001 to 0.006%.

* * * * *

UNITED STATES PATENT AND TRADEMARK OFFICE

CERTIFICATE OF CORRECTION

PATENT NO. : 5,798,004

DATED : August 25, 1998

INVENTOR(S) : Hiroshi TAMEHIRO, et al.

It is certified that error appears in the above-identified patent and that said Letters Patent is hereby corrected as shown below:

Column 2, line 23, between "is" and "when" near end of line insert --1--.

Column 3, line 24, delete "is".

Column 10, Table 1, line 6, change "0.132" to --0.032--.

Column 12, Table 2, line 11,change "20" to --28--.

Column 14, Table 4, line 5, change "105" to ---105--.

Column 16, Table 5, line 5, change "2.2" to --2.29--.

Column 17, line 12, change "claims" to --claim--.

Column 18, line 5, change "<" to — ≤ —.

Column 18, line 7, change "<" to — ≤ —.

Column 18, line 8, change "<" to — ≤ —.

UNITED STATES PATENT AND TRADEMARK OFFICE

CERTIFICATE OF CORRECTION

PATENT NO. : 5,798,004

DATED : August 25, 1998

INVENTOR(S) : Hiroshi TAMEHIRO, et al.

It is certified that error appears in the above-identified patent and that said Letters Patent is hereby corrected as shown below:

Column 18, line 42, delete "any of".

Signed and Sealed this

Thirty-first Day of October, 2000

*Attest:*

*Attesting Officer*

Q. TODD DICKINSON

*Director of Patents and Trademarks*